US006285325B1

(12) United States Patent
Nalbandian et al.

(10) Patent No.: US 6,285,325 B1
(45) Date of Patent: Sep. 4, 2001

(54) COMPACT WIDEBAND MICROSTRIP ANTENNA WITH LEAKY-WAVE EXCITATION

(75) Inventors: Vahakn Nalbandian, Ocean, NJ (US); Choon Sae Lee, Dallas, TX (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/505,090

(22) Filed: Feb. 16, 2000

(51) Int. Cl.[7] ..... H01Q 3/02
(52) U.S. Cl. ..... 343/700 MS; 343/830
(58) Field of Search ..... 343/700 MS, 849, 343/829, 830, 859, 702, 772, 853, 818, 846

(56) References Cited

U.S. PATENT DOCUMENTS 4,924,236 * 5/1990 Schuss et al. ..... 343/700 MS
5,319,378 * 6/1994 Nalbandian et al. ..... 343/700 MS
5,448,252 * 9/1995 Ali et al. ..... 343/700 MS
5,561,435 * 10/1996 Nalbandian et al. ..... 343/700 MS
5,767,810 * 6/1998 Hagiwara et al. ..... 343/700 MS
6,005,519 * 12/1999 Burns ..... 343/700 MS

* cited by examiner

*Primary Examiner*—Don Wong
*Assistant Examiner*—Chuc Tran
(74) *Attorney, Agent, or Firm*—Michael Zelenka; George B. Tereschuk

(57) ABSTRACT

A compact wideband leaky-wave excitation microstrip antenna is provided by a group of microstrip patches disposed on a top region of a dielectric substrate stacked on a conductive ground plane. The top region of the dielectric substrate and the dielectric substrate can be composed of either the same or different dielectric materials. A means for feeding an RF signal, which can be a center feed pin, that normally touches the top conducting patch is electrically isolated from the radiating patches. This arrangement confines the feed current within the probe pin to give an increased input resistance. The compact wideband leaky-wave excitation microstrip antenna permits significant reductions in antenna size, resulting in microstrip antennas with a smaller surface area.

18 Claims, 2 Drawing Sheets

COMPACT WIDEBAND MICROSTRIP ANTENNA WITH LEAKY-WAVE EXCITATION

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to the field of microstrip antennas, and more particularly to a compact wideband leaky-wave excitation microstrip antenna.

BACKGROUND OF THE INVENTION

Microstrip antennas are lightweight, low profile and low cost devices with a cylindrical and conformal structure suitable for replacing bulky antennas. Microstrip antennas have an inherently narrow (less than 5%) frequency bandwidth that limits more widespread usage. Numerous attempts to increase this bandwidth have met only limited success. Conventional microstrip antennas use a resonant cavity model to achieve a narrow bandwidth. Previous wide-band antennas like the horn, helix and log periodical antennas all suffer from being bulky, heavy and nonconformal. Combining the best characteristics of the microstrip and wideband antenna into one antenna would be most advantageous.

Up until now, it has not been possible to employ microstrip antennas without the disadvantages, limitations and shortcomings associated with a narrow bandwidth. By applying leaky-wave excitation to microstrip antennas, the present invention provides wideband microstrip antennas with compact size. This invention's wideband leaky-wave microstrip antenna provides a small antenna size making it ideal for antenna array elements. A leaky-wave can be excited in a waveguide of periodically placed microstrip patches on a dielectric substrate backed by a ground plane. While most transmission lines are designed to carry electromagnetic energy without much loss, a leaky-wave loses its energy along the propagation path. A simple way to produce a leaky wave is to excite the high-order modes in the transmission line. However it can be difficult to match the input impedance because the characteristic impedance and propagation constant of the leaky-wave depend on the strip width, which is the only variable in the design process at a given layer thickness with a standard substrate material. In this invention's antenna, gaps are introduced periodically in the microstrip transmission line. The resultant leaky-wave structure provides greater antenna design freedom and flexibility making it possible to design an antenna for a desired propagation constant while the input impedance is properly matched.

The compact wideband leaky-wave excitation microstrip antenna of the present invention provides the same high efficiency as in conventional microstrip antennas, with the key advantage over prior art antennas of having wide bandwidth and a similar surface area. The present invention advantageously answers the long-felt need for the low cost, compact, planar and conformal properties of microstrip material in an antenna with expanded frequency bandwidth using leaky-wave radiation.

SUMMARY OF THE INVENTION

It is an object of the present invention to provide a compact wideband leaky-wave excitation microstrip antenna.

Another object of the present invention is to provide a group of microstrip patches placed on a dielectric substrate and conductive ground plate for a compact wideband leaky-wave excitation microstrip antenna with a reduced antenna surface area.

These and other objects are advantageously accomplished with the present invention by providing a compact wideband leaky-wave excitation microstrip antenna comprising a group of microstrip patches disposed on a dielectric substrate stacked on a conductive ground plane. The dielectric substrate has a top region on a top surface of the dielectric substrate, and the top region and the dielectric substrate can be composed of either the same or different dielectric materials. In this invention, a means for feeding an RF signal, which can be a center feed pin, is electrically isolated from the radiating microstrip patches.

The antenna of the present invention is a compact wideband leaky-wave excitation microstrip antenna comprising a group of microstrip patches disposed on a dielectric substrate stacked on a conductive ground plane, with an electrically isolated center feed mechanism. The inventors herein have discovered that when several patches form a microstrip antenna cavity, the radiation comes from not only the traditional radiation edges, as would be expected, but also from the top surface, which is usually covered by a single patch in a conventional rectangular microstrip antenna. Thus, the radiation from the top surface of the leaky-wave microstrip antenna is much stronger than that from the edge surfaces. When the radiated power increases relative to the stored energy in the cavity, the Q factor becomes small, resulting in a large bandwidth. However the impedance matching will be increasingly difficult for a larger bandwidth because the resistive part of the input impedance exceeds the maximum value when a conventional feeding technique is used.

To overcome the problems associated with difficulties in impedance matching, the present inventors developed a new current feeding scheme to provide impedance matching when the Q value becomes very small. In the compact wideband leaky-wave excitation microstrip antenna of the present invention, a means for feeding an RF signal, such as a center feed pin, which normally touches the top conducting patch is electrically isolated from the radiating patches. In this way, the feed current is confined within the probe pin to give an increased input resistance. In accordance with the present invention, significant reductions in antenna surface area have been achieved, resulting in shorter microstrip antennas.

DETAILED DESCRIPTION OF THE DRAWINGS

Figure 1:
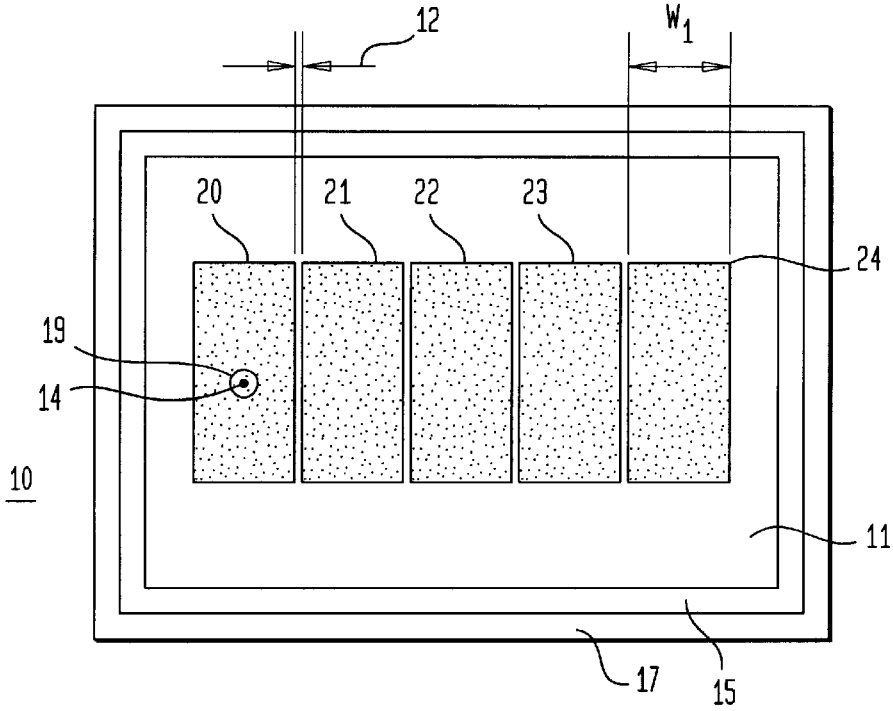
FIG. 1 is a top view of the compact wideband leaky-wave excitation microstrip antenna of the present invention.

Referring now to the drawings, FIG. 1 is a top view of the compact wideband leaky-wave excitation microstrip antenna 10 comprising a plurality of microstrip patches

20–24 disposed on a top dielectric region 11. Gap 12 separates each microstrip patch 20–24, with only one gap 12 identified for the sake of simplicity. The microstrip patches 20–24 are electrically coupled, and each microstrip patch 20–24 has the same width $W_1$. The top region 11 covers most of a top surface 15 of a dielectric substrate 16 and is also dielectric. Also depicted in this drawing is the edge of a conductive ground plate 17. Dielectric substrate 16 is sandwiched between the plurality of microstrip patches 20–24 and the conductive ground plate 17, but is not visible from this figure's top view. A means for feeding an RF signal 14 projects upward through the center of microstrip patch 20 and is electrically isolated from microstrip patches 20–24. Positioning the feeding means 14 to be electrically isolated within insulation gap 19 in this way thereby confines the feed current within the feeding means 14 to provide an increased input resistance.

Figure 2:
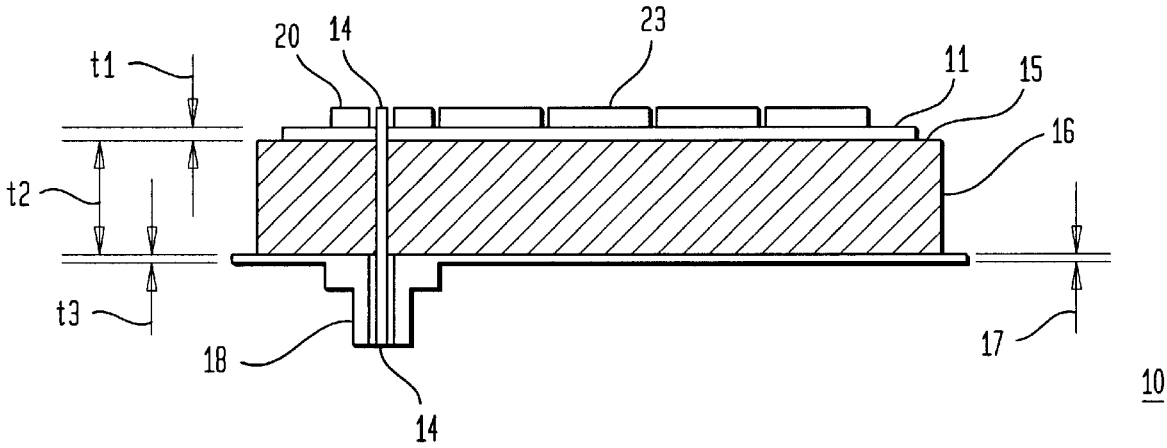
FIG. 2 is a side view of the compact wideband leaky-wave excitation microstrip antenna of the present invention.

FIG. 2 affords a side view illustrating the structure of the present invention. Referring now to FIG. 2, the compact wide-band leaky-wave excitation microstrip antenna 10 comprises the top region 11 on the top surface 15 of the dielectric substrate 16, which is stacked on a conductive plate 17. The top region 11 and the dielectric substrate 16 can be machined from a single dielectric material, or, as in the case of the preferred embodiment can be composed of two separate dielectric materials such as Duroid™ for the top region 11 and Styrofoam™ for dielectric substrate 16. The feeding means 14 is connected to a means for connecting 18, which is, in turn, connected to an RF source, not shown in this drawing.

In the laboratory, an antenna 10 having five copper conductive patches 20–24 separated by very small gaps 12 (0.02 cm) provided the optimum performance. Also, the measurements represented by the FIG. 3 chart indicate that a relatively thick structure with these representative dimensions was needed. Thickness $t_1$, of a Duroid™ top region 11 is 0.063 cm with a dielectric constant of 10.2. Thickness $t_2$ of dielectric substrate 16 is a 1.1 cm thick Styrofoam™ with a dielectric constant of approximately 1.06. When dielectric substrate 16 and top region 11 are composed of different dielectric materials, the dielectric substrate 16 can also function as a spacer. Thickness $t_3$ of ground plate 17 is 0.08 cm. The very thin 0.063 cm Duroid™ top region 11 on the surface 15 of the dielectric substrate 16 permits accurate photo-etching of the antenna structure 10. Thickness $t_2$ of dielectric substrate 16 is greater than thickness $t_1$ of the top dielectric region 11. The feeding means 14 extends through the conductive ground plane 17 upward and passes through both dielectric materials of dielectric substrate 16 and dielectric tray 11 and is 1.3 cm in length, with a 0.125 cm diameter.

Referring back to FIG. 1, the insulation gap 19 where copper or similar conductive material has been removed from conductive patch 20 is a 0.15 cm wide diameter, slightly exaggerated for illustrative purposes, and is somewhat wider than the 0.125 diameter of the feeding means 14. This arrangement prevents feeding means 14 from making ohmic contact with the surrounding microstrip patch 20 and the other patches 21–24, thereby confining the feed current to the feeding means 14 to provide increased input resistance and reducing the current in the feed for better impedance matching.

Figure 3:
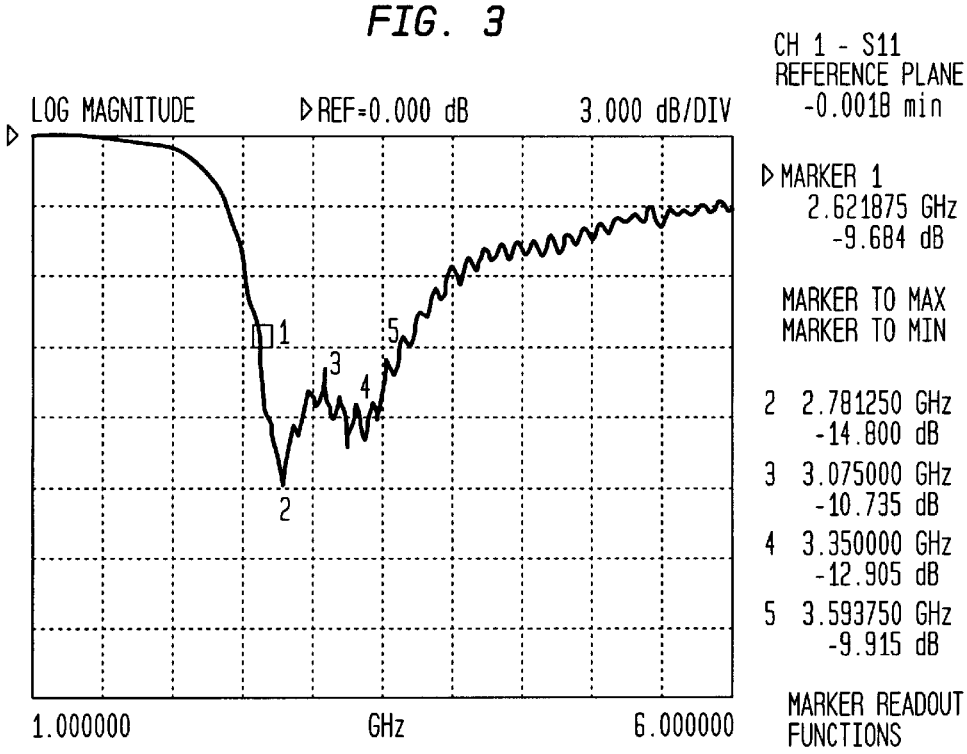
FIG. 3 is a chart showing the return loss vs. frequency of the compact wideband leakywave excitation microstrip antenna of the present invention.
Figure 4:
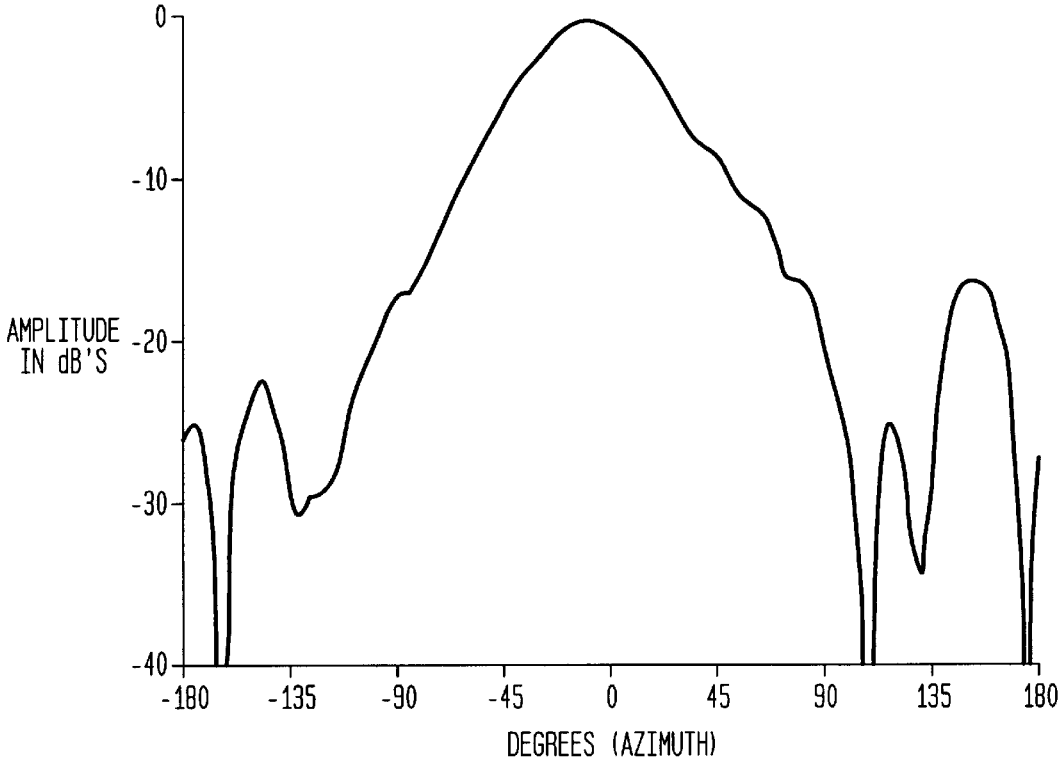
FIG. 4 is a chart showing the radiation patterns of the compact wideband leaky-wave excitation microstrip antenna of the present invention.

The 5 patch embodiment of this invention's antenna has demonstrated a 30% frequency bandwidth as indicated in the FIG. 3 return loss vs. frequency chart, as well as the good antenna patterns shown on the FIG. 4 chart. In accordance with the present invention, similar results may be achieved with a 4, 5 or 6 patch configuration. Referring now to FIG. 3, this chart illustrates the return loss as a function of frequency. The X axis represents frequency in GHz and the Y axis represents magnitude in decibels. A similar antenna was fabricated by using only Duroid™ material ($\epsilon_r$=2.2) of a thickness of 1.25 cm. This antenna also gave a large bandwidth of 30%.

FIG. 4 is a chart illustrating the radiation patterns for the 5 patch embodiment described above. A typical single patch 3.00 GHz microstrip antenna with 3% bandwidth, using a dielectric of $\epsilon_r$=2.2, has a patch area of 3.3×4.5 cm, but other patch areas can also be effectively employed in accordance with the present invention. Each of the conductive patches 20–24 has the same width, $W_1$. The total 5 patch area of this invention's leaky-wave antenna 10 is 2 ×5 cm with a 30% bandwidth using similar dielectric material. This small area wideband antenna makes an excellent element for the antenna array with wide bandwidths. This antenna can handle high power level, making it ideal for pulsed power systems.

A number of variations of the present invention are possible. For example, the top dielectric region 11 may be made of Duroid™ dielectric material having a dielectric constant of approximately 10.2. The top region 11 and the dielectric substrate 16 can be machined from a single dielectric material, or, as in the case of the preferred embodiment can be composed of separate dielectric materials such as Duroid™ for the top region 11 and Styrofoam™ for the dielectric substrate 16. Dielectric substrate 16 may also be configured in a honey-comb structure. Additionally, numerous other dielectric materials may be successfully employed, including dielectric constants of 2.2. Ground plate 17 and microstrip patches 20–24 may be made of any conductive material, such as silver, copper or another good electrical conductor. Microstrip patches 20–24 are formed on the top region 11 of the dielectric substrate 16 by any conventional means, such as deposition or etching, or may be attached with adhesive. Different sizes of the conductive patches 20–24 may be utilized to modify the antenna radiation patterns and the resonant frequencies. However, in order to efficiently radiate in the leaky-wave transmission mode, the longitudinal length should be relatively long. This permits more energy to be radiated while the electromagnetic radiation travels longitudinally along the length of the antenna. Additionally, a triangular shape for each patch is also possible. Variations in the dimensions of the microstrip patches will also impact the frequency of the antenna 10.

Additionally, while several embodiments have been illustrated and described, it will be obvious to those skilled in the art that various modifications may be made without departing from the spirit and scope of this invention.

What we claim is:

1. A compact wideband leaky-wave excitation microstrip antenna, comprising:

a plurality of microstrip patches arranged on a top region of a dielectric substrate;

said dielectric substrate being stacked on a ground plate;

said plurality of microstrip patches forming a microstrip antenna cavity storing a quantity of stored electrical energy;

a means for feeding an RF signal extends from said ground plate through said dielectric substrate to an insulation gap within a first microstrip patch of said plurality of microstrip patches;

said antenna having a given Q factor, a given bandwidth and a given surface area;

each of said plurality of microstrip patches being separated by a gap and electrically coupled;

said plurality of microstrip patches, being electrically coupled and arranged on said top region, produce a quantity of electrical coupling to excite leaky-wave radiation having a higher voltage than said quantity of stored electrical energy decreasing said given Q to a reduced Q factor;

said reduced Q factor resulting in an increased bandwidth wider than said given bandwidth; and said insulation gap, having a wider diameter than said feeding means, prevents ohmic contact between said feeding means and said first microstrip patch to provide an increased input resistance, an improved impedance matching and a wide bandwidth to permit a decreased antenna surface area.

2. The compact wideband leaky-wave excitation microstrip antenna, as recited in claim 1, further comprising said top region being on a top surface of said dielectric substrate.

3. The compact wideband leaky-wave excitation microstrip antenna, as recited in claim 2, further comprising said feeding means being located within said insulation gap without contacting said first microstrip patch.

4. The compact wideband leaky-wave excitation microstrip antenna, as recited in claim 3, further comprising said ground plate being conductive.

5. The compact wideband leaky-wave excitation microstrip antenna, as recited in claim 4, further comprising said plurality of microstrip patches being rectangular.

6. The compact wideband leaky-wave excitation microstrip antenna, as recited in claim 5, further comprising:

said top region having a thickness $t_1$;

said dielectric substrate having a thickness $t_2$; and said ground plate having a thickness $t_3$.

7. The compact wideband leaky-wave excitation microstrip antenna, as recited in claim 6, further comprising said top region and said dielectric substrate being constructed of different dielectric materials.

8. The compact wideband leaky-wave excitation microstrip antenna, as recited in claim 7, further comprising said feeding means being coupled to a coaxial connector.

9. The compact wideband leaky-wave excitation microstrip antenna, as recited in claim 8, further comprising said feeding means being an electrical feed line.

10. The compact wideband leaky-wave excitation microstrip antenna, as recited in claim 9, further comprising said feeding means being an SMA center feed pin.

11. The compact wideband leaky-wave excitation microstrip antenna, as recited in claim 10, further comprising said plurality of microstrip patches being between four and seven microstrip patches.

12. The compact wideband leaky-wave excitation microstrip antenna, as recited in claim 11, further comprising said plurality of microstrip patches being five microstrip patches.

13. The compact wideband leaky-wave excitation microstrip antenna, as recited in claim 12, further comprising said antenna providing a 30% frequency bandwidth.

14. The compact wideband leaky-wave excitation microstrip antenna, as recited in claim 13, further comprising forming said plurality of conductive patches with a thin conductive material on said top region.

15. The compact wideband leaky-wave excitation microstrip antenna, as recited in claim 14, further comprising said thin conductive material being sufficiently thin to permit accurate photo-etching of said plurality of conductive patches.

16. The compact wideband leaky-wave excitation microstrip antenna, as recited in claim 15, further comprising said top region having a dielectric constant of approximately 10.

17. The compact wideband leaky-wave excitation microstrip antenna, as recited in claim 16, further comprising said top region having a dielectric constant of 10.

18. The compact wideband leaky-wave excitation microstrip antenna, as recited in claim 17, further comprising said dielectric substrate having a dielectric constant of approximately 1.0.

* * * * *